US005550015A

United States Patent [19]

Karthäuser

[11] Patent Number: 5,550,015

[45] Date of Patent: Aug. 27, 1996

[54] PRODUCTION OF SILVER HALIDE EMULSIONS COMPRISING TABULAR GRAINS

[75] Inventor: Silvia Karthäuser, Köln, Germany

[73] Assignee: Agfa-Gevaert AG, Leverkusen, Germany

[21] Appl. No.: 366,404

[22] Filed: Dec. 29, 1994

Related U.S. Application Data

[63] Continuation of Ser. No. 178,511, Jan. 7, 1994, abandoned, which is a continuation-in-part of Ser. No. 28,221, Mar. 9, 1993, abandoned.

[30] Foreign Application Priority Data

Mar. 20, 1992 [DE] Germany ..... 42 09 023.7
Jul. 21, 1992 [DE] Germany ..... 42 24 027.1

[51] Int. Cl.[6] ..... G03C 1/015

[52] U.S. Cl. ..... 430/569; 430/567

[58] Field of Search ..... 430/567, 569

[56] References Cited

U.S. PATENT DOCUMENTS 4,692,400 9/1987 Kumashiro et al. ..... 430/567
4,713,318 12/1987 Sugimoto et al. ..... 430/567
4,990,437 2/1991 Iijima et al. ..... 430/567
5,250,403 10/1993 Antoniides et al. ..... 430/569

*Primary Examiner*—Janet C. Baxter
*Attorney, Agent, or Firm*—Connolly & Hutz

[57] ABSTRACT

The process for the production of a platelike silver halide emulsion having an AgBrI core of which the iodide content is at least 2.5 mol-% and a first shell of AgBrI surrounding the core, of which the iodide content is 40±4 mol-% and at least one other shell of low iodide content, comprising (a) precipitating a core containing 2 to 20 mol-% of AgI by the double jet method at 30° to 50° C. and pBr 1.2 to 2.3, (b) subjecting the core to physical ripening at 60° to 80° C. and pBr 1.2 to 2.8, (c) growing the grains by adding silver ions and also bromide and iodide ions to the ripened core grains, the bromide and iodide each are added in an amount that the bromide iodide composition falls within the miscibility gap and (d) precipitating at least one other silver halide layer having an iodide content below 20 mol-% leads to an improved grain-to-sensitivity ratio.

9 Claims, No Drawings

PRODUCTION OF SILVER HALIDE EMULSIONS COMPRISING TABULAR GRAINS

This application is a continuation of application Ser. No. 08/178,511 filed on Jan. 7, 1994, which is now abandoned, which was a continuation-in-part of application Ser. No. 08/028,221 filed on Mar. 9, 1993, now abandoned.

This invention relates to the production of a silver halide emulsion having improved properties.

It is known that platelike silver halide crystals have higher spectral sensitivity compared with compact silver halide crystals of the same molecular weight by virtue of their greater surface-to-volume ratio.

It is also known that the sensitivity of silver halide crystals increases with their iodide content. However, it has not yet been possible to produce platelike silver halide emulsions having high iodide contents in their interior, i.e. in the core of the crystal, because no platelike crystals are formed during nucleus precipitation of the core with relatively large quantities of iodide. However, once a compact habit of the crystals has been established by core precipitation, it cannot effectively be changed into a platelike habit.

A process which overcomes this difficulty has now been found. In this process, the growth phase is carried out with bromide/iodide ratios—whether in the form of aqueous solutions containing bromide and iodide ions or silver micrate emulsions of corresponding composition—which already lie in the silver bromide iodide miscibility gap. It is known that this miscibility gap extends from 40±4 to 90 mol-% AgI (H. Hirsch, J. Photogr. Sci., 10, 129 (1962); O. Stasiv and J. Teltow, Z. anorg. chem. 259, 143 (1949); H. Chateau, M. C. Moncet and J. Pouradier in "Wissenschaftliche Photographie" verlag Dr. O Helwich, Darmstadt, 1958, page 20). The percentage of iodide in the miscibility gap increases the iodide content of the platelike core with its relatively low iodide content, but does not change its platelike habit.

The platelike AgBrI crystals obtained in this way have a core which contains a relatively large quantity of iodide and a shell of AgBrI surrounding the core of which the iodide content is at the limit of the miscibility gap (approx. 40 mol-%).

Other layers are then precipitated onto these crystals to produce a photographically useable emulsion.

Platelike emulsions are preferably silver halide emulsions having an aspect ratio of 3 to 10.

The aspect ratio is the ratio of the diameter of a circle—having the same surface area as the projected area of the platelike crystal—to the thickness of the platelike crystal.

Accordingly, the present invention relates to a process for the production of a platelike silver halide emulsion having an AgBrI core of which the iodide content is at least 2.5 mol-% and a first shell of AgBrI surrounding the core, of which the iodide content is 40±4 mol-% and at least one other shell of low iodide content, comprising (a) precipitating a core containing 2 to 20 mol-% of AgI by the double jet method at 30° to 50° C. and pBr 1.2 to 2.3, (b) subjecting the core to physical ripening at 60° to 80° C. and pBr 1.2 to 2.8, (c) growing the grains by adding silver ions and also bromide and iodide ions to the ripened core grains, the bromide and iodide each are added in an amount that the bromide iodide composition falls within the miscibility gap and (d) precipitating at least one other silver halide layer having an iodide content below 20 mol-%.

Step (c) may be carried out by addition of (cl) at least two solutions, one of which contains $Ag^+$ ions and the other(s) $Br^\ominus$ ions and $I^\ominus$ ions in the desired ratio, (c2) at least two micrate emulsions, of which one is an AgI emulsion and the other(s) AgBr or AgBrI emulsions, of which the iodide content may extend to the miscibility gap, the total bromide-to-iodide ratio again being the desired ratio, or (c3) any combination of c1 and c2, the desired bromide-to-iodide ratio having to be maintained, are added to the core precipitate after physical ripening. Micrate emulsions are emulsions having an average crystal diameter (volume key point) of less than 0.1 μm.

The platelike grains amount to at least 80% of the total projected area of the platelike silver halide emulsion according to the invention.

Various methods are available for determining the halide distribution of the multiple-layer crystal structure:

Element distribution is determined with very high local resolution on thin sections of silver halide crystals by STEM/EDX (Scanning Transmission Electron Microscope/Energy Dispersive X-Ray Analyzer) [M. Inoue, Int. Symp. Charac. Silver Halides, Japan (1989) 2].

Back scattered electron imaging (BSEI) is particularly suitable for determining the distribution of elements in plate crystals [X. Gao et al., J. Imag. Sci. 33 (1989) 87].

Element depth profiles and surface distributions on silver halide crystals can be determined by secondary ion mass spectrometry (SIMS) and high-resolution SIMS [T. Maternaghan et al., J. Imag. Sci. 34 (1990) 58].

The other layer(s) to be applied by precipitation are preferably AgCl, AgBr, AgClBr, AgBrI and AgClBrI layers having maximum iodide contents of 20 mol-%.

In one preferred embodiment, precipitation of the first shell, which at the same time increases the iodide content of the core, is carried out by continuously reducing the iodide content of the combined precipitation solutions or the combined micrate emulsions during precipitation to the value of the lower limit of the miscibility gap. Unwanted new core formation of pure AgI crystals is avoided this way.

According to the invention, this shell may also be produced by keeping the bromide-to-iodide ratio constant and altering, more particularly reducing, the pBr value during precipitation.

Desalting of the emulsion is best carried out both after precipitation of the first shell and also in the final emulsion.

The halide composition of the combined precipitation solutions for producing the first shell is, in particular, 40 to 70 mol-% iodide and 60 to 30 mol-% bromide.

The core preferably makes up 1 to 6 mol-% of the total crystal and, in any event, has a larger iodide content than the core precipitate and, in particular, consists of AgBrI with an iodide content of 3 to 30 mol-%.

The first shell preferably makes up 3 to 40 mol-% of the total crystal and consists in particular of AgBrI with an iodide content at the lower limit of the miscibility gap (40±4 mol-% $I^\ominus$).

The other shell(s) in particular have the composition $AgBr_{0-100}Cl_{0-100}I_{0-20}$. The outermost shell preferably has the composition $AgBr_{97-100}I_{0-3}$.

The halide composition can change continuously between the first shell and the following shell. It preferably changes discontinuously.

The average crystal diameter (volume key point) may be between 0.5 and 2.0 μm. The crystal size distribution may be both heterodisperse and also substantially homodisperse.

Photographic materials distinguished by an improved grain-to-sensitivity ratio can be obtained with the silver halide emulsion produced in accordance with the invention.

Examples of color photographic materials are color negative films, color reversal films, color positive films, color photographic paper, color reversal photographic paper, dye-sensitive materials or the dye diffusion transfer process or the silver dye bleaching process. The material according to the invention is preferably a color negative film.

Suitable supports for the production of color photographic materials are, for example, films of semisynthetic and synthetic polymers, such as cellulose nitrate, cellulose acetate, cellulose butyrate, polystyrene, polyvinyl chloride, polyethylene terephthalate and polycarbonate, and paper laminated with a baryta layer or α-olefin polymer layer (for example polyethylene). These supports may be dyed with dyes and pigments, for example titanium dioxide. They may also be dyed black for the purpose of screening against light. The surface of the support is generally subjected to a treatment to improve the adhesion of the photographic emulsion layer, for example to a corona discharge with subsequent application of a substrate layer.

In addition to the red-sensitive silver halide emulsion layer, the green-sensitive silver halide emulsion layer and the blue-sensitive silver halide emulsion layer, the color photographic materials also contain interlayers and protective layers.

Binders, silver halide crystals and color couplers are essential constituents of the photographic emulsion layers.

Gelatine is preferably used as binder although it may be completely or partly replaced by other synthetic, semisynthetic or even naturally occurring polymers. Synthetic gelatine substitutes are, for example, polyvinyl alcohol, poly-N-vinyl pyrrolidone, polyacrylamides, polyacrylic acid and derivatives thereof, particularly copolymers. Naturally occurring gelatine substitutes are, for example, other proteins, such as albumin or casein, cellulose, sugar, starch or alginates. Semisynthetic gelatine substitutes are generally modified natural products. Cellulose derivatives, such as hydroxyalkyl cellulose, carboxymethyl cellulose, and phthalyl cellulose and also gelatine derivatives which have been obtained by reaction with alkylating or acylating agents or by grafting on of polymerizable monomers are examples of such modified natural products.

The binders should contain an adequate number of functional groups, so that sufficiently resistant layers can be produced by reaction with suitable hardeners. Functional groups of the type in question are, in particular, amino groups and also carboxyl groups, hydroxyl groups and active methylene groups.

The gelatine preferably used may be obtained by acidic or alkaline digestion. Oxidized gelatine may also be used. The production of such gelatines is described, for example, in The Science and Technology of Gelatine, edited by A. G. Ward and A. Courts, Academic Press 1977, pages 295 et seq. The particular gelatine used should contain as few photographically active impurities as possible (inert gelatine).

In addition to the silver halide emulsions according to the invention, the photographic material may also contain other silver halide emulsions.

The average particle size of the emulsions is preferably between 0.2 μm and 2.0 μm; the particle size distribution may be both homodisperse and heterodisperse. A homodisperse particle size distribution means that 95% of the particles differ from the average particle size by no more than ±30%. In addition to the silver halide, the emulsions may also contain organic silver salts, for example silver benztriazolate or silver behenate.

The emulsions are preferably silver bromide iodide emulsions containing up to 18 mol-% iodide. They may contain both compact and platelike silver halide crystals provided that at least one emulsion is a platelike emulsion prepared according to this invention.

Two or more types of silver halide emulsions prepared separately may also be used in the form of a mixture.

The photographic emulsions may be prepared from soluble silver salts and soluble halides by various methods (cf. for example P. Glafkides, Chimie et Physique Photographique, Paul Montel, Paris (1967); G. F. Duffin, Photographic Emulsion Chemistry, The Focal Press, London (1966); V. L. Selikman et al. Making and Coating Photographic Emulsion, The Focal Press, London (1966)).

Salts or complexes of metals, such as Cd, Zn, Pb, Tl, Bi, Ir, Rh, Fe, may also be present during the precipitation and/or physical ripening of the silver halide crystals.

In addition, precipitation may even be carried out in the presence of sensitizing dyes. Complexing agents and/or dyes may be inactivated at any time, for example by changing the pH value or by an oxidative treatment.

On completion of crystal formation or even at an earlier stage, the soluble salts are removed from the emulsion, for example by noodling and washing, by flocculation and washing, by ultrafiltration or by ion exchangers.

The silver halide emulsion is generally subjected to chemical sensitization under defined conditions (pH, pAg, temperature, gelatine, silver halide and sensitizer concentration) until sensitivity and fogging are both optimal. The process is described, for example, in H. Frieser "Die Grundlagen der Photographischen Prozesse mit Silberhalogeniden", pages 675–734, Akademische Verlagsgesellschaft (1968).

Chemical sensitization may be carried out with addition of compounds of sulfur, selenium, tellurium and/or compounds of metals of the VIIIth secondary group of the periodic system (for example gold, platinum, palladium, iridium). Thiocyanate compounds, surface-active compounds, such as thioethers, heterocyclic nitrogen compounds (for example imidazoles, azaindenes) or even spectral sensitizers (described for example in F. Hamer "The Cyanine Dyes and Related Compounds", 1964, and in Ullmanns Encyclopädie der technischen Chemie, 4th Edition, Vol. 18, pages 431 et seq and Research Disclosure No. 17643, Chapter III) may also be added. Reduction sensitization with addition of reducing agents (tin(II) salts, amines, hydrazine derivatives, aminoboranes, silanes, formamidine sulfinic acid) may be carried out instead of or in addition to chemical sensitization by hydrogen, by a low pAg value (for example below 5) and/or a high pH value (for example above 8).

The photographic emulsions may contain compounds to prevent fogging or to stabilize the photographic function during production, storage and photographic processing.

Particularly suitable compounds of this type are azaindenes, preferably tetra- and pentaazaindenes, particularly those substituted by hydroxyl or amino groups. Compounds such as these are described, for example, by Birr, Z. Wiss. Phot. 47 (1952) pages 2 to 58. Other suitable antifogging agents are salts of metals, such as mercury or cadmium, aromatic sulfonic acids or sulfinic acids, such as benzenesulfinic acid, or nitrogen-containing heterocycles, such as nitrobenzimidazole, nitroindazole, optionally substituted benztriazoles or benzthiazolium salts. Heterocycles containing mercapto groups are particularly suitable, examples of such compounds being mercaptobenzthiazoles, mercaptobenzimidazoles, mercaptotetrazoles, mercaptothiadiazoles, mercaptopyrimidines; these mercaptoazoles may even contain a water-solubilizing group, for example a carboxyl group or sulfo group. Other suitable compounds are published in Research Disclosure No. 17643 (1978), Chapter VI.

The stabilizers may be added to the silver halide emulsions before, during or after ripening. The compounds may of course also be added to other photographic layers associated with a silver halide layer.

Mixtures of two or more of the compounds mentioned may also be used.

The photographic emulsion layers or other hydrophilic colloid layers of the photosensitive material produced in accordance with the invention may contain surface-active agents for various purposes, such as coating aids, for preventing electrical charging, for improving surface slip, for emulsifying the dispersion, for preventing adhesion and for improving the photographic characteristics (for example development acceleration, high contrast, sensitization, etc.). In addition to natural surface-active compounds, for example saponin, synthetic surface-active compounds (surfactants) are mainly used: nonionic surfactants, for example alkylene oxide compounds, glycerol compounds or glycidol compounds; cationic surfactants, for example higher alkylamines, quaternary ammonium salts, pyridine compounds and other heterocyclic compounds, sulfonium compounds or phosphonium compounds; anionic surfactants containing an acid group, for example a carboxylic acid, sulfonic acid, phosphoric acid, sulfuric acid ester or phosphoric acid ester group; ampholytic surfactants, for example amino acid and aminosulfonic acid compounds and also sulfuric or phosphoric acid esters of an aminoalcohol.

The photographic emulsions may be spectrally sensitized using methine dyes or other dyes. Particularly suitable dyes are cyanine dyes, merocyanine dyes and complex merocyanine dyes.

A review of the polymethine dyes suitable as spectral sensitizers, suitable combinations thereof and supersensitizing combinations thereof can be found in Research Disclosure 17643/1978, Chapter IV.

The following dyes (in order of spectral regions) are particularly suitable:

1. As red sensitizers 9-ethylcarbocyanines with benzthiazole, benzselenoazole or naphthothiazole as basic terminal groups, which may be substituted in the 5- and/or 6-position by halogen, methyl, methoxy, carbalkoxy, aryl, and also 9-ethyl naphthoxathia- or selenocarbocyanines and 9-ethyl naphthothiaoxa- and benzimidazocarbocyanines, providing the dye contains at least one sulfoalkyl group at the heterocyclic nitrogen.
2. As green sensitizers 9-ethylcarbocyanines with benzoxazole, naphthoxazole or a benzoxazole and a benzthiazole as basic terminal groups and also benzimidazocarbocyanines which may also be further substituted and must also contain at least one sulfoalkyl group at the heterocyclic nitrogen.
3. As blue sensitizers symmetrical or asymmetrical benzimidazo-, oxa-, thia- or selenacyanines containing at least one sulfoalkyl group at the heterocyclic nitrogen and, optionally, other substituents at the aromatic nucleus and also apomerocyanines containing a thiocyanine group.

Non-diffusing monomeric or polymeric color couplers are associated with the differently sensitized emulsion layers and may be arranged in the same layer or in an adjacent layer.

Cyan couplers are normally associated with the red-sensitive layers, magenta couplers with the green-sensitive layers and yellow couplers with the blue-sensitive layers.

color couplers for producing the cyan component dye image are generally couplers of the phenol or α-naphthol type.

Color couplers for producing the magenta component dye image are generally couplers of the 5-pyrazolone, indazolone or pyrazoloazole type.

Color couplers for producing the yellow component dye image are generally couplers containing an open-chain ketomethylene group, more especially couplers of the α-acyl acetamide type, of which suitable examples are α-benzoyl acetanilide couplers and α-pivaloyl acetanilide couplers.

The color couplers may be 4-equivalent couplers and also 2-equivalent couplers. 2-Equivalent couplers are derived from the 4-equivalent couplers in that they contain in the coupling position a substituent which is eliminated during the coupling reaction. 2-Equivalent couplers include both those which are substantially colorless and also those which have a strong color of their own which either disappears during the color coupling reaction or is replaced by the color of the image dye produced (mask couplers) and white couplers which give substantially colorless products on reaction with color developer oxidation products. 2-Equivalent couplers also include couplers which, in the coupling position, contain a releasable group which is released on reaction with color developer oxidation products and develops a certain desired photographic activity, for example as a development inhibitor or accelerator, either directly or after one or more other groups have been released from the group initially released (for example DE-A-27 03 145, DE-A-28 55 697, DE-A-31 05 026, DE- A-33 19 428). Examples of 2-equivalent couplers such as these are the known DIR couplers and also DAR and FAR couplers.

DIR couplers containing development inhibitors of the azole type, for example triazoles and benzotriazoles, are described in DE-A-24 14 006, 26 10 546, 26 59 417, 27 54 281, 28 42 063, 36 26 219, 36 30 564, 36 36 824, 36 44 416. Further advantages in regard to color reproduction, i.e. color separation and color purity, and in regard to detail reproduction, i.e. sharpness and graininess, can be obtained with DIR couplers which, for example, do not release the development inhibitor as the direct result of coupling with an oxidized color developer, but only after a further reaction, for example with a timing group. Examples of DIR couplers such as these can be found in DE-A-28 55 697, 32 99 671, 38 18 231, 35 18 797, in EP-A-0 157 146 and 0 204 175, in US-A-4,146,396 and. 4,438,393 and in GB-A-2,072,363.

DIR couplers releasing a development inhibitor which is decomposed in the developer bath to photographically substantially inactive products are described, for example, in DE-A-3 209 486 and in EP-A-0 167 168 and 0 219 713. Problem-free development and stable processing are achieved by this measure.

Where DIR couplers, particularly those releasing a readily diffusible development inhibitor, are used, improvements in color reproduction, for example a more differentiated color reproduction, can be obtained by suitable measures during optical sensitization, as described for example in EP-A-0 115 304, 0 167 173, GB-A-2,165,058, DE-A-37 00 419 and U.S. Pat. No. 4,707,436.

In a multilayer photographic material, the DIR couplers may be added to various layers, including for example even non-photosensitive layers or interlayers. However, they are preferably added to the photosensitive silver halide emulsion layers, the characteristic properties of the silver halide emulsion, for example its iodide content, the structure of the silver halide grains or their grain size distribution, influencing the photographic properties obtained. The effect of the inhibitors released may be limited, for example by the incorporation of an inhibitor-trapping layer according to DE-A-24 31 223. For reasons of reactivity or stability, it may be of advantage to use a DIR coupler which, in the particular layer into which it is introduced, forms a color differing from the color to be produced in that layer during the coupling reaction.

To increase sensitivity, contrast and maximum density, it is possible to use above all DAR or FAR couplers which release a development accelerator or a fogging agent. Compounds of this type are described, for example, in DE-A-25 34 466, 32 09 110, 33 33 355, 34 10 616, 34 29 545, 34 41 823, in EP-A-0 089 834, 0 110 511, 0 118 087, 0 147 765 and in U.S. Pat. No. 4,618,572 and 4,656,123.

An example of the use of BAR (bleach accelerator releasing) couplers can be found in EP-A-193 389.

It can be of advantage to modify the effect of a photographically active group released from the coupler by an intermolecular reaction between this group after its release and another group in accordance with DE-A-35 06 805.

Since, in the case of DIR, DAR and FAR couplers, the activity of the group released during the coupling reaction is largely desirable with less importance being attributed to the dye-producing properties of these couplers, DIR, DAR and FAR couplers which give substantially colorless products during the coupling reaction are also suitable (DE-A15 47 640).

The releasable group may also be a ballast group, so that coupling products which are diffusible or which at least show slight or limited mobility are obtained in the reaction with color developer oxidation products (U.S. Pat. No. 4,420,556).

The material may also contain compounds different from couplers which may release, for example, a development accelerator, a bleach accelerator, a developer, a silver halide solvent, a fogging agent or an anti-fogging agent, for example so-called DIR hydroquinones and other compounds of the type described, for example, in U.S. Pat. Nos. 4,636, 546, 4,345,024, 4,684,604 and in DE-A-31 45 640, 25 15 213, 24 47 079 and in EP-A-198 438. These compounds perform the same function as the DIR, DAR or FAR couplers except that they do not form coupling products.

High molecular weight color couplers are described, for example, in DE-C-1 297 417, DE-A-24 07 569, DE-A-31 48 125, DE-A-32 17 200, DE-A-33 20 079, DE-A-33 24 932, DE-A33 31 743, DE-A-33 40 376, EP-A-27 284, U.S. Pat. No. 4,080,211. The high molecular weight color couplers are generally produced by polymerization of ethylenically unsaturated monomeric color couplers. However, they may also be obtained by polyaddition or polycondensation. High molecular weight couplers (latex couplers) are preferably used in the layers containin the high-chloride emulsions.

The couplers or other compounds may be incorporated in silver halide emulsion layers by initially preparing a solution, a dispersion or an emulsion of the particular compound and then adding it to the casting solution for the particular layer. The choice of a suitable solvent or dispersant depends upon the particular solubility of the compound.

Methods for introducing compounds substantially insoluble in water by grinding processes are described, for example, in DE-A-26 09 741 and DE-A-26 09 742.

Hydrophobic compounds may also be introduced into the casting solution using high-boiling solvents, so-called oil formers. Corresponding methods are described, for example in U.S. Pat. Nos. 2,322,027, 2,801,170, 2,801,171 and EP-A-0 043 037.

Instead of using high-boiling solvents, it is also possible to use oligomers or polymers, so-called polymeric oil formers.

The compounds may also be introduced into the casting solution in the form of charged latices, cf. for example DE-A-25 41 230, DE-A-25 41 274, DE-A-28 35 856, EP-A-0 014 921, EP-A-0 069 671, EP-A-0 130 115, U.S. Pat. No. 4,291,113.

Anionic water-soluble compounds (for example dyes) may also be incorporated in non-diffusing form with the aid of cationic polymers, so-called mordant polymers.

Suitable oil formers are, for example, phthalic acid alkyl esters, phosphonic acid esters, phosphoric acid esters, citric acid esters, benzoic acid esters, amides, fatty acid esters, trimesic acid esters, alcohols, phenols, aniline derivatives and hydrocarbons.

Examples of suitable oil formers are dibutyl phthalate, dicyclohexyl phthalate, di-2-ethyl hexyl phthalate, decyl phthalate, triphenyl phosphate, tricresyl phosphate, 2-ethyl hexyl diphenyl phosphate, tricyclohexyl phosphate, tri-2-ethyl hexyl phosphate, tridecyl phosphate, tributoxyethyl phosphate, trichloropropyl phosphate, di-2-ethyl hexyl phenyl phosphate, 2-ethyl hexyl benzoate, dodecyl benzoate, 2-ethyl hexyl-p-hydroxybenzoate, diethyl dodecaneamide, N-tetradecyl pyrrolidone, isostearyl alcohol, 2,4-di-tert.-amylphenol, dioctyl acetate, glycerol tributyrate, isostearyl lactate, trioctyl citrate, N,N-dibutyl-2-butoxy- 5-tert.-octyl aniline, paraffin, dodecylbenzene and diisopropyl naphthalene.

The non-photosensitive interlayers generally arranged between layers of different spectral sensitivity may contain agents to prevent unwanted diffusion of developer oxidation products from one photosensitive layer into another photosensitive layer with different spectral sensitization.

Suitable agents of the type in question, which are also known as scavengers or DOP trappers, are described in Research Disclosure 17 643 (Dec. 1978), Chapter VII, 17 842 (Feb. 1979) and 18 716 (Nov. 1979), page 650 and in EP-A-0 069 070, 0 098 072, 0 124 877, 0 125 522.

The photographic material may also contain UV absorbers, whiteners, spacers, filter dyes, formalin scavengers, light stabilizers, antioxidants, $D_{min}$ dyes, additives for improving dye, coupler and white stabilization and for reducing color fogging, plasticizers (latices), biocides and other additives.

UV-absorbing compounds are intended on the one hand to protect image dyes against fading under the effect of UV-rich daylight and, on the other hand, as filter dyes to absorb the UV component of daylight on exposure and thus to improve the color reproduction of a film. Compounds of different structure are normally used for the two functions. Examples are aryl-substituted benzotriazole compounds (U.S. Pat. No. 3,533,794), 4-thiazolidone compounds (U.S. Pat. No. 3,314,794 and 3,352,681), benzophenone compounds (JP-A2784/71), cinnamic acid ester compounds (U.S. Pat. No. 3,705,805 and 3,707,375), butadiene compounds (U.S. Pat. No. 4,045,229) or benzoxazole compounds (U.S. Pat. No. 3,700,455).

It is also possible to use UV-absorbing couplers (such as cyan couplers of the α-naphthol type) and UV-absorbing polymers. These UV absorbers may be fixed in a special layer by mordanting.

Filter dyes suitable for visible light include oxonol dyes, hemioxonol dyes, styryl dyes, merocyanine dyes, cyanine dyes and azo dyes. Of these dyes, oxonol dyes, hemioxonol dyes and merocyanine dyes may be used with particular advantage.

Suitable whiteners are described, for example, in Research Disclosure 17 643 (December 1978), Chapter V, in U.S. Pat. Nos. 2,632,701 and 3,269,840 and in GB-A-852, 075 and 1,319, 763.

Certain binder layers, particularly the layer furthest from the support, but occasionally interlayers as well, particularly where they are the layer furthest from the support during production, may contain inorganic or organic, photographically inert particles, for example as matting agents or as spacers (DE-A-33 31 542, DE-A-34 24 893, Research Disclosure 17 643, Dec. 1978, Chapter XVI).

The mean particle diameter of the spacers is particularly in the range from 0.2 to 10 μm. The spacers are insoluble in water and may be insoluble or soluble in alkalis, the alkali-soluble spacers generally being removed from the photographic material in the alkaline development bath. Examples of suitable polymers are polymethyl methacrylate, copolymers of acrylic acid and methyl methacrylate and also hydroxypropyl methyl cellulose hexahydrophthalate.

Additives for improving dye, coupler and white stability and for reducing color fogging (Research Disclosure 17 643 (December 1978), Chapter VII) may belong to the following classes of chemical compounds: hydroquinones, 6-hydroxychromanes, 5-hydroxycoumaranes, spirochromanes, spiroindanes, p-alkoxyphenols, sterically hindered phenols, gallic acid derivatives, methylenedioxybenzenes, aminophenols, sterically hindered amines, derivatives containing esterified or etherified phenolic hydroxyl groups, metal complexes.

Compounds containing both a sterically hindered amine partial structure and also a sterically hindered phenol partial structure in one and the same molecule (U.S. Pat. No. 4,268,593 ) are particularly effective for preventing the impairment of yellow dye images as a result of the generation of heat, moisture and light. Spiroindanes (JP-A-159 644/81) and chromanes substituted by hydroquinone diethers or monoethers (JP-A-89 835/80) are particularly effective for preventing the impairment of magenta-red dye images, particularly their impairment as a result of the effect of light.

The layers of the photographic material may be hardened with the usual hardeners. Suitable hardeners are, for example, formaldehyde, glutaraldehyde and similar aldehyde compounds, diacetyl, cyclopentadione and similar ketone compounds, bis-(2-chloroethylurea), 2-hydroxy-4, 6dichloro-1,3,5-triazine and other compounds containing reactive halogen (U.S. Pat. Nos. 3,288,775, 2,732,303, GB-A-974,723 and GB-A-1,167,207), divinylsulfone compounds, 5-acetyl-1, 3-diacryloyl hexahydro- 1,3,5-triazine and other compounds containing a reactive olefin bond (U.S. Pat. Nos. 3,635, 718, 3,232,763 and GB-A-994,869); N-hydroxymethyl phthalimide and other N-methylol compounds (U.S. Pat. No. 2,732,316 and U.S. Pat. No. 2,586,168); isocyanates (U.S. Pat. No. 3,103,437); aziridine compounds (U.S. Pat. No. 3,017,280 and U.S. Pat. No. 2,983,611); acid derivatives (U.S. Pat. No. 2,725,294 and U.S. Pat. No. 2,725,295); compounds of the carbodiimide type (U.S. Pat. No. 3,100,704); carbamoyl pyridinium salts (DE-A-22 25 230 and DE-A-24 39 551); carbamoyloxy pyridinium compounds (DE-A-24 08 814); compounds containing a phosphorus-halogen bond (JP-A-113 929/83); N-carbonyloximide compounds (JP-A-43353/81); N-sulfonyloximido compounds (U.S. Pat. No. 4,111,926), dihydroquinoline compounds (U.S. Pat. No. 4,013,468), 2-sulfonyloxy pyridinium salts (JP-A-110 762/81), formamidinium salts (EP-A-0 162 308), compounds containing two or more N-acyloximino groups (U.S. Pat. No. 4,052,373), epoxy compounds (U.S. Pat. No. 3,091,537), compounds of the isoxazole type (U.S. Pat. No. 3,321,313 and U.S. Pat. No. 3,543,292); halocarboxaldehydes, such as mucochloric acid; dioxane derivatives, such as dihydroxydioxane and dichlorodioxane; and inorganic hardeners, such as chrome alum and zirconium sulfate.

Hardening may be carried out in known manner by adding the hardener to the casting solution for the layer to be hardened or by overcoating the layer to be hardened with a layer containing a diffusible hardener.

Among the classes mentioned, there are slow-acting and fast-acting hardeners and also so-called instant hardeners which are particularly advantageous. Instant hardeners are understood to be compounds which crosslink suitable binders in such a way that, immediately after casting but at the latest 24 hours and, preferably 8 hours after casting, hardening has advanced to such an extent that there is no further change in the sensitometry and swelling of the layer combination as a result of the crosslinking reaction. By swelling is meant the difference between the wet layer thickness and dry layer thickness during aqueous processing of the film (Photogr. Sci. Eng. 8 (1964), 275; Photogr. Sci. Eng. (1972), 449).

These hardeners which react very quickly with gelatine are, for example, carbamoyl pyridinium salts which are capable of reacting with free carboxyl groups of the gelatine so that these groups react with free amino groups of the gelatine with formation of peptide bonds and crosslinking of the gelatine.

color photographic negative materials are normally processed by development, bleaching, fixing and washing or by development, bleaching, fixing and stabilization without subsequent washing; bleaching and fixing may be combined into a single process step. Suitable color developer compounds are any developer compounds which are capable of reacting in the form of their oxidation product with color couplers to form azomethine or indophenol dyes. Suitable color developer compounds are aromatic compounds containing at least one primary amino group of the p-phenylenediamine type, for example N,N-dialkyl-p-phenylenediamines, such as N,N-diethyl-p-phenylenediamine,1-(N-ethyl-N-methanesulfonamidoethyl)- 3-methyl-p-phenylenediamine, 1-(N-ethyl-N-hydroxyethyl)- 3-methyl-p-phenylenediamine and 1-(N-ethyl-N-methoxyethyl)-3-methyl-p-phenylenediamine. Other useful color developers are described, for example, in J. Amer. Chem. Soc. 73, 3106 (1951) and in G. Haist, Modern Photographic Processing, 1979, John Wiley and Sons, New York, pages 545 et seq.

Color development may be followed by an acidic stop bath or by washing.

The material is normally bleached and fixed immediately after color development. Suitable bleaches are, for example, Fe(III) salts and Fe(III) complex salts, such as ferricyanides, dichromates, water-soluble cobalt complexes. Particularly preferred bleaches are iron(III) complexes of aminopolycarboxylic acids, more especially for example ethylenediamine tetraacetic acid, propylenediamine tetraacetic acid, diethylenetriamine pentaacetic acid, nitrilotriacetic acid, alanine diacetic acid iminodiacetic acid, N-hydroxyethyl ethylene diamine triacetic acid, alkyliminodicarboxylic acids, and of corresponding phosphonic acids. Other suitable bleaches are persulfates and peroxides, for example hydrogen peroxide.

The bleaching/fixing bath or fixing bath is generally followed by washing which is carried out in countercurrent or consists of several tanks with their own water supply.

Favorable results can be obtained where a following finishing bath containing little or no formaldehyde is used.

However, washing may be completely replaced by a stabilizing bath which is normally operated in countercurrent. Where formaldehyde is added, this stabilizing bath also performs the function of a finishing bath.

Color reversal materials are first subjected to development with a black-and-white developer of which the oxidation product is not capable of reacting with the color couplers.

Development is followed by a diffuse second exposure and then by development with a color developer, bleaching and fixing.

Emulsion 1 (Comparison Emulsion)

Core precipitation and physical ripening

3 Liters of a 1.5% by weight aqueous gelatine solution are initially introduced. 120 ml of a 1-molar aqueous $AgNO_3$ solution and 120 ml of a 1-molar potassium halide solution of 97.5 mol-% KBr and 2.5 mol-% KI are then run into this solution by the double jet method at 40° C. and pBr 1.3 24 ml of a 5% by weight aqueous solution of 3,6-dithiaoctane-8-diol are then added and the solution is heated to 70° C. 200 ml of a 20% by weight gelatine solution are then added and the pBr value is adjusted to 1.5. The emulsion has an average diameter (volume key point) of 0.4 μm.

Precipitation 1080 ml 1-molar aqueous $AgNO_3$ solution and as many ml 1-molar aqueous potassium halide solution of 60 mol-% KBr and 40 mol-% KI to keep the pBr value at 1.5 are run in by the double jet method over a period of 105 minutes. After half the $AgNO_3$ solution has been run in, 500 ml of a 10% by weight aqueous gelatine solution are added.

The gelatine silver bromide iodide emulsion is desalted by ultrafiltration.

The AgBrI emulsion obtained has an average particle diameter (volume key point) of 0.8 μm, a distribution coefficient of 25, a core (12 tool-%) having the composition $AgBr_{97}I_3$, a shell having the composition $AgBr_{63.5}I_{36.5}$ and a platelike habit with an aspect ratio of 5.

A second shell of AgBr is precipitated onto this emulsion, so that a silver bromide iodide emulsion having a layered crystal structure, an average diameter (volume key point) of 1.17 μm and the composition $AgBr_{90}I_{10}$ is obtained (see Table 1).

Emulsion 2 (Invention)

The procedure is the same as described for the production of emulsion 1, except that a potassium halide solution having the composition 55 mol-% KBr and 45 mol-% KI is run in during precipitation.

The AgBrI emulsion obtained had the an average particle diameter (volume key point) of 0.68 μm, a distribution coefficient of 27, a core (15 mol-%) having the composition $AgBr_{93}I_7$, a shell having the composition $AgBr_{60.5}I_{39.5}$ and a platelike habit with an aspect ratio of 5.

A second shell of AgBr is precipitated onto this emulsion, so that a silver bromide iodide emulsion having a layered crystal structure, an average diameter (volume key point) of 0.99 μm and the composition $AgBrs_{90}I_{10}$ is obtained (see Table 1).

Emulsion 3 (Invention)

The procedure is the same as described for the production of emulsion 1, except that a pBr value of 1.7 is adjusted after core precipitation and is continuously reduced to 1.4 during precipitation.

The core has the composition $AgBr_{96}I_4$ while the first shell has the composition $AgBr_{62}I_{38}$.

A shell of AgBr is again applied by precipitation. An emulsion having a layered crystal structure, an average diameter (volume key point) of 1.18 μm and the composition $AgBr_{90}I_{10}$(see Table 1) is obtained.

Emulsion 4 (Comparison)

A high-sensitivity emulsion produced in accordance with DE 2 828 112 is compared with emulsions 1 to 3:

The emulsion is prepared in two steps. In the first step, the core containing 40 mol-% AgI and 60 mol-% AgBr and having a volume key point $d_v$ of 0.86 μm is obtained. The second step comprises the Ostwald ripening of an AgBr micrate emulsion at 65° C./pBr 0.9. The emulsion thus obtained has a volume key point $d_v$ of 1.45 μm, an aspect ratio of 4 and an average iodide content of 10 mol-%.

A red sensitizer corresponding to the following formula

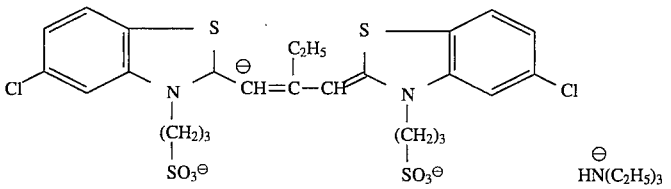

(0.25 mmol/mol AgX) is added to emulsions 1 to 4 which are then subjected to sulfur-gold ripening up to optimal sensitivity.

| | Average particle diameter (volume key point μm) | $S_{rel}$ | Fog | Gamma 1 | Iodide content (mol-%) | Aspect ratio | RMS |
|---|---|---|---|---|---|---|---|
| Emulsion 1 Comparison | 1.17 | 98 | 47 | 76 | 10 | 5 | 11.4 |
| Emulsion 2 Invention | 0.99 | 98 | 51 | 78 | 10 | 5 | 10.5 |

-continued

| | Average particle diameter (volume key point μm) | $S_{rel}$ | Fog | Gamma 1 | Iodide content (mol-%) | Aspect ratio | RMS |
|---|---|---|---|---|---|---|---|
| Emulsion 3 Invention | 1.18 | 103 | 47 | 77 | 10 | 5 | 11.2 |
| Emulsion 4 Comparison | 1.45 | 100 | 47 | 72 | 10 | 4 | 12.8 |

$S_{Rel}$ = Relative sensitivity, emulsion 4 = 100
Gamma 1 = Slope of the characteristic curve at its base
RMS = Grain determination It can be seen that, for the same sensitometric properties, emulsion 2 according to the invention has advantages in regard to particle size and, hence, improved grain and sharpness while emulsion 3 according to the invention has advantages in regard to sensitivity coupled with very good grain.

I claim:

1. A process for the production of a silver halide emulsion containing platelike silver halide grains in at least 80% of the total projected area, said platelike silver halide grains having an AgBrI core of which the silver iodide content is at least 2.5 mol %, a first shell of AgBrI surrounding the core, of which the silver iodide content is 40±4 mol %, and at least one other shell, of which the silver iodide content is below 20 mol %, said process comprising (a) precipitating a core containing 2 to 20 mol % of AgI by the double jet method at 30° to 50° C. and pBr 1.2 to 2.3, (b) subjecting the core to physical ripening at 60° to 80° C. and pBr 1.2 to 2.8, (c) growing the first shell by adding silver ions, bromide ions, and iodide ions to the ripened core-grains, other silver halide layer having a silver iodide content below 20 mol %, wherein the amount of iodide ions added during step (c) is more than 40±4 mol % and less than 90 mol % of the total amount of halide ions added during step (c), the amount of iodide ions added during step (c) is continuously reduced until the lower limit of the miscibility gap of AgBrI is reached at 40±4 mol % silver iodide, and the silver ions, bromide ions, and iodide ions added during step (c) are provided by at least two micrate emulsions of which one is an AgI emulsion and at least one is an AgBr emulsion or an AgBrI emulsion of which the silver iodide content is less than or equal to the lower limit of the miscibility gap.

2. A process as claimed in claim 1, comprising adding in step (c) 40 to 70 mol % iodide and 60 to 30 mol % bromide based on the total amount of halide ions added in step (c).

3. A process as claimed in claim 1, wherein the core contributes 1 to 6 mol % and the first shell 3 to 40 mol % of the total amount of silver halide present in each platelike silver halide grain.

4. A process for the production of a silver halide emulsion containing platelike silver halide grains in at least 80% of the total projected area, said platelike silver halide grains having an AgBrI core of which the silver iodide content is at least 2.5 mol %, a first shell of AgBrI surrounding the core, of which the silver iodide content is 40±4 mol %, and at least one other shell, of which the silver iodide content is below 20 mol %, said process comprising (a) precipitating a core containing 2 to 20 mol % of AgI by the double jet method at 30° to 50° C. and pBr 1.2 to 2.3, (b) subjecting the core to physical ripening at 60° to 80° C. and pBr 1.2 to 2.8, (c) growing the first shell by adding silver ions, bromide ions, and iodide ions to the ripened core grains, and (d) precipitating said at least one other silver halide layer having a silver iodide content below 20 mol %, wherein the amount of iodide ions added during step (c) is more than 40±4 mol % and less than 90 mol % of the total amount of halide ions added during step (c), the amount of iodide ions added during step (c) is continuously reduced until the lower limit of the miscibility gap of AgBrI is reached at 40±4 mol % silver iodide, and the silver ions, bromide ions, and iodide ions added during step (c) are provided by at least two solutions of which one contains silver ions and the other(s) bromide and iodide ions.

5. A process for the production of a silver halide emulsion containing platelike silver halide grains in at least 80% of the total projected area, said platelike silver halide grains having an AgBrI core of which the silver iodide content is at least 2.5 mol %, a first shell of AgBrI surrounding the core, of which the silver iodide content is 40±4 mol %, and at least one other shell, of which the silver iodide content is below 20 mol %, said process comprising (a) precipitating a core containing 2 to 20 mol % of AgI by the double jet method at 30° to 50° C. and pBr 1.2 to 2.3, (b) subjecting the core to physical ripening at 60° to 80° C. and pBr 1.2 to 2.8, (c) growing the first shell by adding silver ions, bromide ions, and iodide ions to the ripened core grains, and (d) precipitating said at least one other silver halide layer having a silver iodide content below 20 mol %, wherein the amount of iodide ions added during step (c) is more than 40±4 mol % and and less than 90 mol % of the total amount of halide ions added during step (c), the amount of iodide ions added during step (c) is continuously reduced until the lower limit of the miscibility gap of AgBrI is reached at 40±4 mol % silver iodide, and during step (c) the pBr value is reduced and the bromide-to iodide ratio constant is kept constant.

6. A process as claimed in claim 5, comprising adding in step (c) 40 to 70 mol % iodide and 60 to 30 mol % bromide based on the total amount of halide ions added in step (c).

7. A process as claimed in claim 5, wherein the core contributes 1 to 6 mol % and the first shell 3 to 40 mol % of the total amount of silver halide present in each platelike silver halide grain.

8. A process as claimed in claim 5, wherein step (c) is carried out with at least two solutions of which one contains $Ag^+$ ions and the other(s) $Br^\ominus$ ions and $I^\ominus$ ions.

9. A process as claimed in claim 5, wherein step (c) is carried out with at least two micrate emulsions of which one is an AgI emulsion and at least one is an AgBr emulsion or AgBrI emulsion of which the silver iodide content is less than or equal to the lower limit of the miscibility gap which is 40±4 mol % silver iodide.

* * * * *

UNITED STATES PATENT AND TRADEMARK OFFICE

CERTIFICATE OF CORRECTION

PATENT NO. : 5,550,015

DATED : August 27, 1996

INVENTOR(S) : Silvia Karthauser

It is certified that error appears in the above-indentified patent and that said Letters Patent is hereby corrected as shown below:

Column 14, line 43, claim 5, "mol % and and", should read--mol % and--;

Signed and Sealed this

Seventeenth Day of December, 1996

*Attest:*

Bruce Lehman

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,550,015

DATED : August 27, 1996

INVENTOR(S) : Silvia Karthauser

It is certified that error appears in the above-indentified patent and that said Letters Patent is hereby corrected as shown below:

Column 14, line 49 (Claim 5), "bromide-to iodide ratio constant is kept constant." should read --bromide-to iodide ratio is kept constant.--

Signed and Sealed this

Fourth Day of February, 1997

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,550,015
DATED : August 27, 1996
INVENTOR(S) : Silvia Karthauser

It is certified that error appears in the above-indentified patent and that said Letters Patent is hereby corrected as shown below:

In Column 13, line 33 (Claim 1), the phrase "and d) precipitating said at least one" should be inserted after the phrase "ripened core grains," and before the phrase "other silver halide".

Signed and Sealed this

Third Day of June, 1997

*Attest:*

*Attesting Officer*

Bruce Lehman

BRUCE LEHMAN

*Commissioner of Patents and Trademarks*